US008540225B2

(12) United States Patent
Ehnstrom

(10) Patent No.: US 8,540,225 B2
(45) Date of Patent: Sep. 24, 2013

(54) QUICK CHANGE VISE JAW SYSTEM

(75) Inventor: William J. Ehnstrom, Cottage Grove, MN (US)

(73) Assignee: Bellatex Industries, LLC, Prior Lake, MN (US)

( * ) Notice: Subject to any disclaimer, the term of this patent is extended or adjusted under 35 U.S.C. 154(b) by 214 days.

(21) Appl. No.: 13/083,133

(22) Filed: Apr. 8, 2011

(65) Prior Publication Data

US 2012/0256362 A1 Oct. 11, 2012

(51) Int. Cl.
*B25B 5/16* (2006.01)
*B25B 1/10* (2006.01)

(52) U.S. Cl.
USPC ..... 269/282; 269/242; 269/246

(58) Field of Classification Search
USPC ..... 269/242, 261, 262, 271, 279, 280, 269/282, 283, 287, 246
See application file for complete search history.

(56) References Cited

U.S. PATENT DOCUMENTS

| | | | | |
|---|---|---|---|---|
| 7,343 | A | 5/1850 | Dorn | |
| 985,682 | A | 2/1911 | Landreth | |
| 990,186 | A | 4/1911 | Berg | |
| 994,240 | A | 6/1911 | Bingham | |
| 1,195,339 | A | 8/1916 | Codding et al. | |
| 1,579,582 | A * | 4/1926 | Voltz | 269/283 |
| 2,366,519 | A * | 1/1945 | Greenberg | 81/6 |
| 2,708,854 | A | 5/1955 | Makholm | |
| 2,734,409 | A | 2/1956 | Schum et al. | |
| 2,876,667 | A | 3/1959 | Smith | |
| 2,880,638 | A * | 4/1959 | Muggli et al. | 269/139 |
| 3,341,190 | A | 9/1967 | Adamson | |
| 4,078,782 | A | 3/1978 | Carlson | |
| 4,251,066 | A * | 2/1981 | Bowling | 269/283 |
| 4,291,870 | A | 9/1981 | Warde | |
| 4,437,654 | A | 3/1984 | Chiappetti | |
| 4,462,581 | A | 7/1984 | Mitani | |
| 4,489,929 | A | 12/1984 | Blechschmidt | |
| 4,602,772 | A * | 7/1986 | Wight et al. | 269/282 |
| 4,706,949 | A | 11/1987 | Dossey et al. | |
| 4,750,722 | A | 6/1988 | Chick | |
| 4,798,371 | A * | 1/1989 | Wallisser | 269/283 |
| 4,861,010 | A * | 8/1989 | Neil | 269/282 |
| 4,923,186 | A * | 5/1990 | Durfee, Jr. | 269/282 |
| 4,960,270 | A | 10/1990 | Fitzpatrick | |
| 5,037,075 | A * | 8/1991 | Durfee, Jr. | 269/282 |
| 5,060,920 | A * | 10/1991 | Engibarov | 269/282 |
| 5,065,990 | A * | 11/1991 | Durfee | 269/282 |
| 5,078,372 | A | 1/1992 | Fitzpatrick | |

(Continued)

*Primary Examiner* — Lee D Wilson
*Assistant Examiner* — Jamal Daniel
(74) *Attorney, Agent, or Firm* — Thomas J. Nikolai; Nikolai & Mersereau, P.A.

(57) ABSTRACT

A master jaw assembly used in a vise including a locking jaw, a detachable jaw and a clamping device disposed in the locking jaw, securely clamping the detachable jaw to the locking jaw. The locking jaw has a groove extending along an inner surface of the locking jaw defined by a first and second edge. The second edge is tapered inward and downward toward the base. The detachable jaw has a dovetail protrusion along one side surface thereof. The clamping device includes a plurality of specially-shaped clamp-nuts having a downwardly tapered edge, said clamp-nuts designed to receive one end of a double-ended threaded stud. The detachable jaw becomes fixed to the locking jaw by inserting the protrusion into the groove and torquing the studs to tighten the clamp-nuts downward against the protrusion such that the protrusion is clamped between the taper of the second edge and the clamp-nuts.

11 Claims, 2 Drawing Sheets

(56) References Cited

U.S. PATENT DOCUMENTS

| | | | | |
|---|---|---|---|---|
| 5,096,172 | A | 3/1992 | Mills et al. | |
| 5,150,888 | A * | 9/1992 | Durfee | 269/254 CS |
| 5,191,822 | A * | 3/1993 | Borzym | 83/466 |
| 5,197,834 | A * | 3/1993 | Chase et al. | 409/131 |
| 5,322,305 | A * | 6/1994 | Cross et al. | 279/124 |
| 5,509,644 | A | 4/1996 | Engibarov | |
| 5,893,551 | A | 4/1999 | Cousins et al. | |
| 5,921,534 | A | 7/1999 | Swann et al. | |
| 6,170,813 | B1 | 1/2001 | Bowers | |
| 6,427,995 | B1 | 8/2002 | Steinwall | |
| 6,530,567 | B1 | 3/2003 | Lang | |
| 7,156,384 | B1 | 1/2007 | Varnau | |
| 8,152,175 | B1 * | 4/2012 | Maro et al. | 279/123 |
| 2010/0181714 | A1 | 7/2010 | Calhoun et al. | |
| 2010/0219573 | A1 * | 9/2010 | O'Rell et al. | 269/246 |

* cited by examiner

QUICK CHANGE VISE JAW SYSTEM

BACKGROUND OF THE INVENTION

I. Field of the Invention

This invention relates generally to an improvement in engineers' vises or the like, and more particularly to master jaw assemblies for the quick removal and attachment of hard and soft jaws.

II. Discussion of the Prior Art

An engineer's vise is used in metalworking applications. An engineer's vise, like a woodworking vise, is used to hold a work piece. Vises have one fixed jaw and another parallel jaw which is moved towards or away from the fixed jaw by a screw. In an engineer's vise, jaws are made either of hard or soft metal. Hard jaws are available with either a coarse gripping surface or are ground flat and smooth. Hard jaws can lead to deformation and error of the finished work piece if the vise is over-tightened, or if the operator is unskilled or negligent in his handling of the work piece around hard jaws. Soft jaws, in contrast, are usually made of a soft metal such as aluminum, plastic or wood. Soft jaws are used to hold delicate work pieces, and can be cut to hold specially shaped work pieces. Soft jaws are typically discarded or recycled after multiple uses.

Because soft jaws are consumable items, it is desirable that they be susceptible to rapid changeover. This requires that soft and hard jaws be prepared for attachment to both the parallel movable jaw and the fixed jaw of the vise. In the prior art, attachable jaws were typically attached to the parallel movable jaw by bolts, requiring holes be drilled into each detachable jaw. U.S. Pat. No. 4,251,066 ("the '066 patent") teaches providing a master jaw assembly including a locking jaw having a means providing a dovetail groove along an inner side for receiving a dovetail of approximately the same cross-section on the outer side of a detachable jaw. The detachable jaw is fastened to the locking jaw by providing a weakened section of the locking jaw, such as a slot, extending along the base of the groove intermediate of the tapers. One or more pins connect the tapers on opposite sides of the weakened section for movement toward and away from one another. When the dovetail is inserted into the groove, the detachable jaw is attached to the locking jaw.

The approach of fastening the detachable jaw to the locking jaw after attachment in the '066 patent has manifest problems. First, the assembly of the '066 patent is incapable of front loading the detachable jaw and requires that the detachable jaw be inserted from the side. Second, it weakens the structural integrity of the locking jaw. After repeated use of moving the tapers back and forth, the locking jaw will distort and weaken so as to be unusable for its intended purpose. Third, because the locking jaw is made of a metal of greater strength than a soft detachable jaw, a great deal of force is required to pull the tapers toward each other to securely capture the dovetail of the detachable jaw. This will strain the operator and add to the time necessary to change out the detachable jaw. Fourth, the fastening approach of the '066 patent will still allow the detachable jaw to slip inside the dovetail groove if the pins do not adequately tighten the locking jaw to pull the tapers toward one another. Fifth, because the pins are placed on either side of the weakened segment of the locking jaw, the tapers will bow in the middle so that the groove will not conform to the cross-section of the dovetail.

It is accordingly a principal object of the present invention to provide a vise where the detachable jaws can be more easily fastened or clamped to locking jaw.

Another object of this invention is to provide a vise where the detachable jaws are comparatively inexpensive.

An additional object of the present invention is to provide a vise where the detachable jaw may be front loaded into the locking jaw.

Another object of this invention is to provide a vise where the detachable jaw may be releasably attached to the locking jaw with less time and effort.

Still another object of this invention is to provide a vise where the detachable jaw may be securely attached to the locking jaw.

A further object of this invention is to provide a vise in which a soft detachable jaw need not be provided in standard lengths, but instead may be cut from stock of the length required to mount a particular work piece.

A further object is to provide an attachment for converting an existing vise of this type to a vise adapted to accomplish one or more of the above noted objects.

SUMMARY OF THE INVENTION

These and other objects are accomplished, in accordance with the illustrated embodiment of the present invention, by providing a master jaw assembly used in a vise that comprises a locking jaw having a groove extending along an inner side of the hard jaw between a top surface and a bottom surface. The groove has a base and is defined by first and second opposing edges. The first edge is flat and the second edge is tapered toward the inward and downward base. The master jaw assembly further includes a detachable jaw with a dovetail protrusion along one side surface thereof. The protrusion is substantially the same width as the groove. A fastening device is disposed in the locking jaw along the first edge.

In accordance with the present invention, the fastening device includes a plurality of bores cut into the base of the locking jaw, a plurality of nut holes cut into a top surface and intersecting the first edge of the locking jaw. A plurality of studs is provided with a right-hand threaded segment, a left-hand threaded segment and an unthreaded segment separating the threaded segments. The right-hand threads are screwed into the bores in the base and a nut operatively engages the left-hand threads of the stud. The nuts further include a downwardly tapered edge. When the dovetail protrusion is inserted into the groove, one edge of the dovetail protrusion engages the tapered edge of the locking jaw, and the other edge of the dovetail protrusion engages the downwardly tapered edge of the nut. The detachable jaw is fastened to the locking jaw by torquing the studs further into the bores and the nuts are pulled through the nut holes and the tapered edges of the nuts engage the dovetail.

BRIEF DESCRIPTION OF THE DRAWINGS

The foregoing features, aspects and advantages of the invention will become apparent to those skilled in the art from the following detailed description of an embodiment, especially when considered in conjunction with the accompanying drawings in which like numerals in the several views refer to corresponding parts.

DESCRIPTION OF THE PREFERRED EMBODIMENT

The following discussion is presented to enable a person skilled in the art to make and use the present teachings. Various modifications to the illustrated embodiments will be readily apparent to those skilled in the art, and the generic principles herein may be applied to other embodiments and applications without departing from the present teachings. Thus, the present teachings are not intended to be limited to the embodiments shown, but are to be accorded the widest scope consistent with the principals and features disclosed herein.

Figure 1:
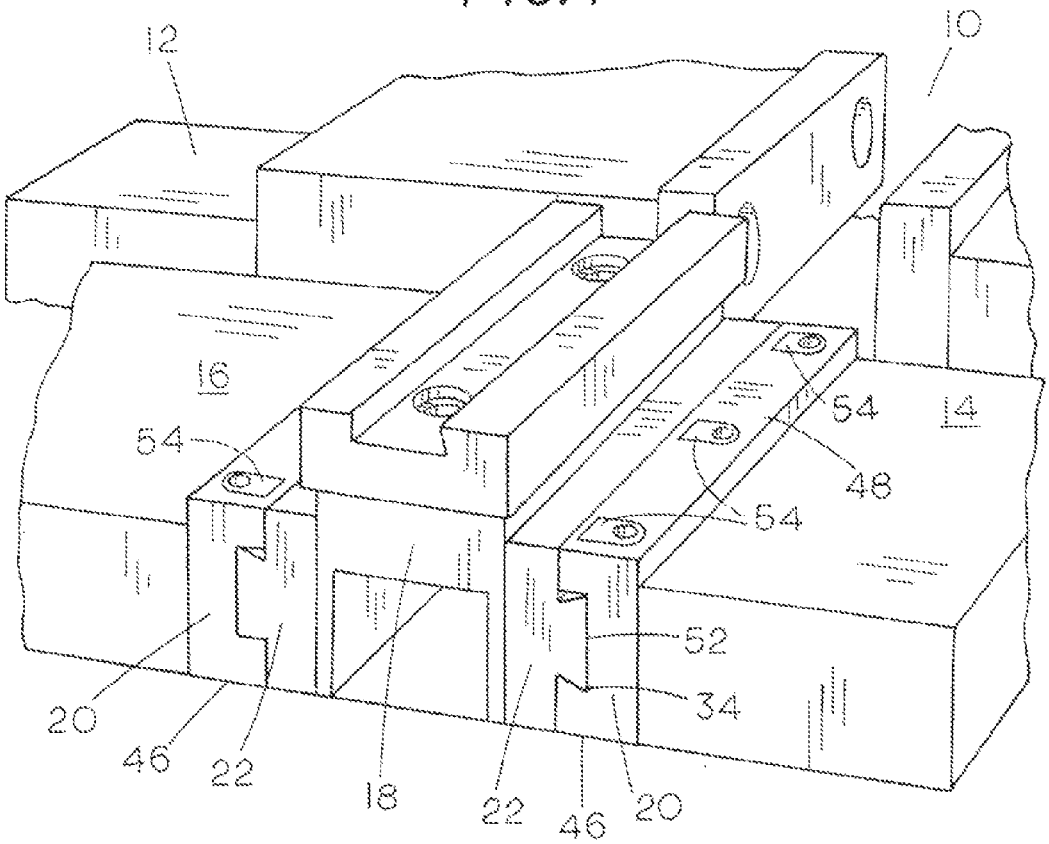
FIG. 1 shows a side perspective view of a vise constructed in accordance with the present invention.

FIG. 1 shows the master jaw assembly 10 as used in a machinist's vise 12. The vise 12 is a standard vise with a fixed jaw 14 and a parallel movable jaw 16, in which the vise 12 is clamped together to hold a work piece 18. The master jaw assembly 10 includes a locking jaw 20 coupled to a detachable jaw 22. A locking jaw 20 is attached to both the fixed jaw 14 and the movable jaw 16 of the vise 12. A detachable jaw 22 is coupled to each locking jaw 20. The work piece 18 is sandwiched between the two detachable jaws 22.

Figure 2:
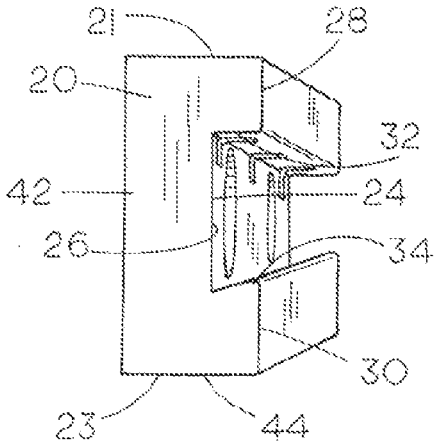
FIG. 2 is an end view of the locking jaw of the master jaw assembly.

FIG. 2 is an end view of the locking jaw 20. The locking jaw 20 includes a groove 24 extending across the inner side of the locking jaw 20 between its top edge 21 and its bottom edge 23. The groove 24 has a base 26 and is defined by a first side edge 28 and a second side edge 30. The first side edge 28 and the second side edge 30 are disposed on either side of the groove 24. The first edge 28 has a flat bottom 32. The second edge 30 includes a taper 34 sloping inward and downward toward base 26.

Figure 3:
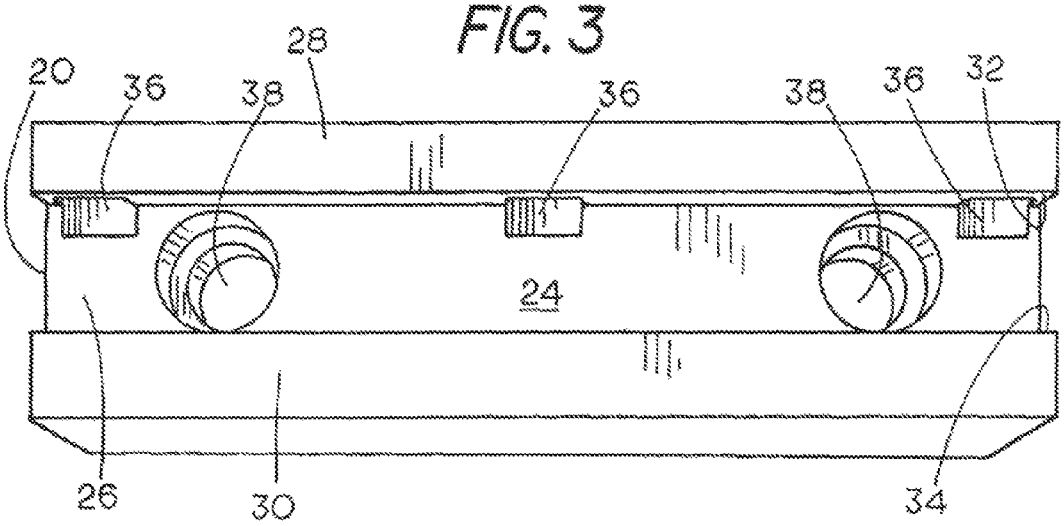
FIG. 3 is a front view of the locking jaw.
Figure 4:
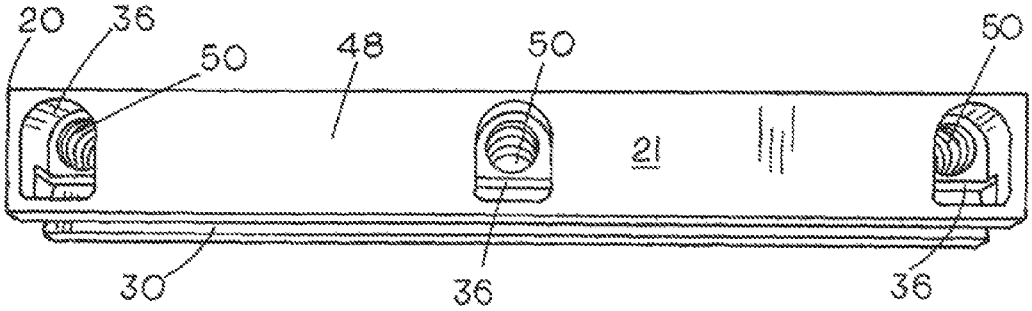
FIG. 4 is a top view of the locking jaw.

As shown in FIG. 3, the locking jaw 20 further includes a plurality of nut holes 36 and a pair of countersunk holes 38. The holes 38 are for accommodating threaded connection of the locking jaw 20 to either the fixed jaw 14 or movable jaw 16 by flat head socket bolts (not shown). When the locking jaws 20 are so attached to the fixed or movable jaws 14 and 16, their outer side surfaces 42 are flush with the inner side surfaces of the fixed or movable jaws, and the lower ends 44 of the locking jaw 20 fit snugly against a top base 46 of the vise. FIG. 4 shows that the upper surface 21 of the locking jaw 20 includes a plurality of the nut holes 36 with tapped bores 50 cut into the base thereof.

Figure 5:
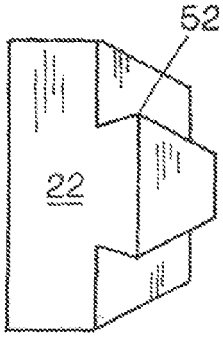
FIG. 5 is a perspective view of the detachable jaw.
Figure 6:
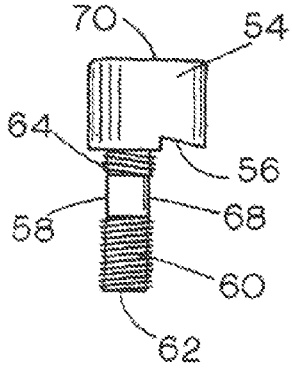
FIG. 6 is a perspective view of the clamping means of the master jaw assembly.

FIG. 5 shows that the detachable soft jaw 22 includes a dovetail protrusion 52 along one side surface thereof. The dovetail protrusion 52 is of substantially the same width as the groove 24 formed in the hard locking jaw 20. The detachable jaw 22 may be made of plastic, aluminum, wood or the like. When the detachable jaw is made of plastic, aluminum or wood, the detachable jaw is a soft jaw. Conversely, the detachable jaw 28 may be made of hard metal and function as a hard jaw.

A clamping means is provided to securely fasten the locking jaw 20 to the detachable jaw 22. The clamping means includes a specially shaped clamp-nut 54 having an inwardly and upwardly tapered edge 56 when viewed as in FIG. 5. The clamp-nut 54 operatively engages a double-ended stud 58, where the stud has right-handed threaded segment 60 over one end portion 62 thereof and a left-handed threaded segment 64 extending over second end portion. An unthreaded segment 68 separates the threaded segments 60, 64. The stud includes a socket at the upper end of segment 64 to accept an Allen wrench tool. The clamp-nut 54 operatively engages the left-hand threaded segment 64 of the stud 58. The nut holes 36 are sized and shaped to receive the clamp-nuts 54. The stud 58 can be screwed into the bores 50 by the right-handed threads 60. When the clamp-nut 54 operatively engages the stud 58 by the left-handed threads 64 and the right-handed threads 60 are screwed clockwise into the bores 50 the nut is carried downward into the nut holes 36. When torqued clockwise all the way down, the top surface 70 of the nut will be flush with the upper end 48 of the locking jaw 20. Conversely, when the stud 58 is torqued counter-clockwise the clamp-nut 54 is raised out of the nut holes 36.

When the dovetail protrusion 52 is inserted into the groove 24, the inward and downward tapered edge 34 engages one side of the dovetail protrusion 52. When screwed downward by torquing the studs 58 clockwise, the clamp-nuts are lowered into the nut holes 36 and the inwardly and downwardly tapered edges 56 thereof come into engagement with the opposing side of the dovetail protrusion 52. Tightening the studs 58 further in a clockwise direction places a downward force on the protrusion 52 and securely clamps it between the inward/downward taper 34 and the inward/upward tapered edge 56 of the clamp-nuts 54, and thus clamp the detachable jaw 22 to the locking jaw 20. Turning the studs 58 in the opposite direction will raise the clamp-nuts 54 and permit the portions of the detachable jaw to be inserted or removed from the groove 24.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

The invention claimed is:

1. A master jaw assembly used in a vise, comprising:

(a) a locking jaw having a groove extending along an inner side surface of the locking jaw, said groove having a base defined by first and second opposed edges where the first edge is normal to the base and the second edge is tapered inward and downward toward the base and with at least one aperture formed inward from a top surface of the locking jaw and intersecting the first edge of the locking jaw;

(b) a detachable jaw having a dovetail protrusion along one side surface thereof of substantially the same width as the groove in the locking jaw;

(c) a clamping means disposed in the locking jaw along the first edge for securely coupling the detachable jaw to the locking jaw wherein the clamping means comprises at least one tapped hole vertically disposed in the base of the locking jaw;

(d) at least one clamp-nut having a threaded bore running longitudinally through a body of the clamp-nut and an inwardly and downwardly tapered edge in a bottom portion of the clamp-nut and wherein said aperture in the locking jaw is sized and shaped to receive and encircle the clamp-nut therein; and (e) at least one double-end stud having a right-hand threaded segment for screwing into the tapped hole in the clamping means and a left-hand threaded segment on the second end for screwing into the threaded bore in the clamp-nut such that when the double-end stud is rotated clockwise, the first end of the double-end stud screws into the tapped hole in the clamping means and draws the clamp-nut downward through the aperture and thereby clamps the dovetail protrusion of the detachable jaw between the second edge of the locking jaw and the tapered edge in the bottom portion of the clamp-nut.

2. The master jaw assembly of claim 1 wherein the locking jaw further includes a pair of holes, in the base.

3. The master jaw assembly of claim 2 wherein the locking jaw is adapted to be releasably attached to inner sides of a fixed jaw and a movable jaw of a vise by bolts passing through the pair of holes.

4. The master jaw assembly of claim 1 wherein the detachable jaw is formed of a length of aluminum stock material and the locking metal jaw is formed of a length of steel stock material.

5. A master jaw assembly used in a vise, comprising:

(a) a locking jaw having a groove extending along an inner side of the locking jaw between a top surface and a bottom surface thereof, said groove having a base and defined by first and second opposing edges, where said first edge is tapered inward and downward toward the base;

(b) a detachable jaw having a dovetail protrusion along one side thereof adapted to mate with said groove; and (c) a fastening device disposed in the locking jaw along the first edge, fastening the locking jaw to the detachable jaw wherein the fastening device includes a plurality of bores formed in the base of the locking jaw;

a plurality of non-circular nut holes formed in an upper surface of the locking jaw and intersecting the first edge of the locking jaw;

a plurality of studs, each having a right-hand threaded segment at one end, a left-hand threaded segment at the opposite end and an unthreaded segment separating the threaded segments;

a plurality of clamp-nuts shaped to be received in the non-circular clamp-nut holes, each one operatively engaging one of the left-hand threaded segments of the studs, each of said clamp-nuts further having a tapered notch in a bottom surface thereof; and wherein the detachable jaw is fastened to the locking jaw by torquing the studs into the bores formed in the locking jaw and the clamp-nuts are pulled through the non-circular nut holes such that the tapered notch in the clamp-nuts engages the dovetail protrusion.

6. The master jaw assembly of claim 5 wherein the locking jaw further includes a pair of holes extending through the base members.

7. The master jaw assembly of claim 5 wherein the locking jaw is adapted to be releasably attached to at least one of the fixed jaw and the moving jaw of a vise.

8. The master jaw assembly of claim 6 wherein the detachable jaw is formed of a length of stock of a material which is less abrasive than that of which the locking jaw is formed.

9. The master jaw assembly of claim 6 wherein the detachable jaw is formed of a length of stock material which is harder than that of which the locking jaw is formed.

10. The master jaw assembly of claim 6 wherein the detachable jaw is formed of a length of material that is longer than the length of the locking jaw.

11. The master jaw assembly of claim 6 wherein the detachable jaw is formed of a length of material that is shorter than the length of the locking jaw.

* * * * *